US008047117B1

(12) United States Patent
Tan

(10) Patent No.: US 8,047,117 B1
(45) Date of Patent: Nov. 1, 2011

(54) COMPOSITE BLAST WAVE ATTENUATORS FOR BOOTS

(75) Inventor: Seng Tan, Beavercreek, OH (US)

(73) Assignee: Wright Materials Research Company, Beaver Creek, OH (US)

( * ) Notice: Subject to any disclaimer, the term of this patent is extended or adjusted under 35 U.S.C. 154(b) by 606 days.

(21) Appl. No.: 11/787,095

(22) Filed: Apr. 13, 2007

(51) Int. Cl.
*F41H 5/08* (2006.01)

(52) U.S. Cl. ..... 89/36.05; 89/36.02; 36/73

(58) Field of Classification Search ..... None
See application file for complete search history.

(56) References Cited

U.S. PATENT DOCUMENTS

| | | | | |
|---|---|---|---|---|
| 3,243,898 | A * | 4/1966 | Quinlan et al. | 36/7.5 |
| 3,318,024 | A * | 5/1967 | Fujinaka et al. | 36/85 |
| 3,516,181 | A * | 6/1970 | Jordan | 36/7.5 |
| 6,006,646 | A * | 12/1999 | Makris et al. | 89/36.05 |
| 6,655,051 | B1 * | 12/2003 | Peche et al. | 36/103 |
| 6,725,572 | B1 * | 4/2004 | Krstic | 36/25 R |
| 6,877,257 | B2 * | 4/2005 | Delgorgue et al. | 36/69 |
| 7,251,835 | B2 * | 8/2007 | Learmont | 2/2.5 |
| 7,530,181 | B2 * | 5/2009 | Joynt et al. | 36/25 R |
| 2002/0011146 | A1 * | 1/2002 | Vaz | 89/36.05 |
| 2003/0009906 | A1 * | 1/2003 | Auberry et al. | 36/7.1 R |
| 2006/0000117 | A1 * | 1/2006 | Joynt et al. | 36/113 |
| 2007/0227040 | A1 * | 10/2007 | Kilgore et al. | 36/25 R |

FOREIGN PATENT DOCUMENTS

GB 2191384 A * 12/1987

* cited by examiner

*Primary Examiner* — Michael Carone
*Assistant Examiner* — Samir Abdosh

(57) ABSTRACT

A blast wave attenuator comprising: a deflector and a foam or foamed composite inside of the deflector. The foamed composite may be a combination of fabrics, fibers, and small reinforcements embedded in a polymeric foam matrix. The foamed composites can be fabricated using a one-step process. The deflector can be manufactured from metal sheets including but not limited to titanium, stainless steel, carbon steel, and superalloys. The blast wave attenuator of the present invention greatly improves the impact resistance and protection of blast protective footwear and combat boots or the like without sacrificing traction or mobility.

18 Claims, 6 Drawing Sheets

Transverse Cross-Sectional View

Transverse Cross-Sectional View

COMPOSITE BLAST WAVE ATTENUATORS FOR BOOTS

The United State of America may have certain rights in this application under the terms of Contracts W911QY-05-C-0026 and W911QY-06-C-0090 from U.S. Army Natick Soldier Center.

FIELD OF THE INVENTION

The present invention relates to apparatus for the deflection of blast waves and more particularly to such devices useful for the deflection of blast waves for combat boots and the like.

BACKGROUND OF THE INVENTION

There are many different kinds of landmines being used in the world. The shock wave created by the main charge of the landmine is used to deliver damage to the victim. In a fragmentation mine, the shock wave is harnessed to shatter the casing of the mine and the detonation gasses immediately behind the shock wave propel the fragmentation into the victim. In a blast mine, the shock wave shatters the bone, ruptures the blood vessels, and tears the soft tissue of a victim and the extremely hot and high-pressure gasses of the detonation products rip apart the remainder of the victim's appendage. This is then followed by high velocity ejecta, which could be soil, pebbles, or fragmentation, which is then hurled into the victim's open wound.

The safest way to approach a mine is in the prone position, and checking the ground with a long probe. This is because the power of a landmine dissipates quickly, and the father away one is, the safer one is. The other reason that the prone position is the best has to do with the fact that the landmine is buried. When it explodes, the explosion has more upward power than outward power, because air offers less resistance than earth. However, in the case of accidental detonation, the foot of the deminer is directly above the explosion. For protection of deminers from accidental detonation, there are three types of protective footwear configurations. The first configuration is a "mattress" that spreads the weight of the deminer over a sufficient area, so that there is not enough pressure on the ground to trigger the mine. This system is not widely used because it offers very little traction to deminers, and they would rather not fall onto a minefield. The second configuration is called the Spider Boot developed by Med-Eng systems in Canada. It supports the wearer's weight on four long legs that increase the standoff distance 15-20 cm. For this reason, the spider boot offers very good protection, and has been used for humanitarian deminers. However, this system is not practical for military deminers, because these shoes are awkward to walk in, and military deminers must be able to operate at 20 feet per minute and combat troops must move at a faster pace. The third system uses blast attenuating materials and designs incorporated into the soles of boots to protect against the blast waves. There are several variations of this concept including Wellco Enterprises "Blast Boot" and their "Blast Overboot". These boots offer the traction and mobility needed by military deminers, but do not offer as much protection as the Spider Boot.

A typical blast wave attenuator made by Wellco Enterprises consists of a carbon steel V-shape deflector, a metal honeycomb (steel or aluminum) that is machined to fit inside the cavity of the V-shape deflector, and a steel sheet covering the honeycomb core. The honeycomb and the entire blast wave attenuator weigh 34.4 gm and 155.5 gm, respectively see, for example FIG. 6 attached hereto.

Today it is estimated that there are 110 million active Anti-Personnel (AP) mines in the world. These weapons remain active for decades after a military conflict and are responsible for killing or maiming up to 500 people a week. Most of the time, a deminer is aware of the landmine, and can take his own precautions, such as increasing the standoff distance to a point where his Personnel Protective Equipment (PPE) will be effective. However, the largest threat to a deminer is accidentally stepping on a mine of which he was unaware. This places his foot and his leg in almost direct contact with the explosion. At such a close proximity, the current blast protective footwear can only prevent the loss of his leg at minimal charge masses. Other options for protection are available, but they suffer from either extremely poor traction or greatly reduced mobility. Humanitarian/civilian deminers can afford to sacrifice their mobility for significantly improved protection. However, military deminers operate at 20 feet per minute and combat troops must operate at an even faster pace. There thus remains a continuing need for protective equipment that increases the survival rate and decreases the severity of harm to human deminers.

There therefore remains a need for blast boots, particularly for military applications that provide the desired blast protection while retaining the mobility required by military deminers.

OBJECT OF THE INVENTION

It is therefore an object of the present invention to provide deflectors that attenuate the blast from mines and the like which deflectors are readily adaptable to combat and similar boots for use by deminers and soldiers without unreasonably restricting the deminers mobility.

SUMMARY OF THE INVENTION

According to the present invention there is provided a blast wave attenuator comprising: a deflector and a foam or foamed composite inside of the deflector. The foamed composite may be a combination of fabrics, fibers, and small reinforcements embedded in a polymeric foam matrix. The foamed composites can be fabricated using a one-step process. The deflector can be manufactured from metal sheets including but not limited to titanium, stainless steel, carbon steel, and superalloys. The blast wave attenuator of the present invention greatly improves the impact resistance and protection of blast protective footwear and combat boots or the like without sacrificing traction or mobility.

DETAILED DESCRIPTION

Figure 1:
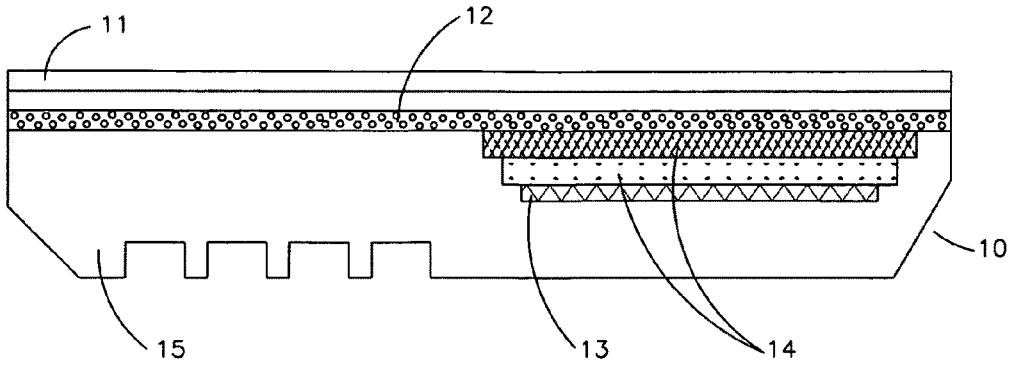
FIG. 1 is a cross-sectional side view of a blast attenuator in accordance with the present invention.

This application relates to lightweight blast wave attenuators for blast and combat boots applications. Additional applications may include footwear for jumping from a high place or subjected to high impact loading.

The inventor of the present invention has previously developed several foaming techniques to process foams from polymers and carbon. For example, advanced polymers, liquid crystalline polymer foams and semi-crystalline foams, described in U.S. Pat. No. 6,232,354 B1 have been developed with and without fibers as reinforcement. The subject matter of this patent is hereby incorporated herein its entirety. These foams have demonstrated excellent impact and blast attenuation properties. The lightweight foamed composites in this invention consist of multiple layers of Kevlar®, Twaron®, or polybenzobisoxazole (PBO) fabrics embedded in a foamed matrix made from engineering polymers like polycarbonate, liquid crystalline polymer (LCP), polyurethane, and polyetherimide (e.g., Ultem®), etc. The manufacturing process of the fabric reinforced polymer foams has been described in a co-pending U.S. patent application Ser. No. 10/982,215 which is similarly incorporated herein in its entirety. The combination of the polymer foam and the ballistic resistant fabrics provides protection for blast wave overpressure, and fragment and shrapnel impact.

In the present invention we have developed new designs of blast wave attenuators for blast boots, combat boots and the like devices that are useful for alleviating the effects of ballistic or high impact activities. The blast attenuators of the present invention comprise two major parts: a deflector including a cavity and a foamed composite filing the cavity to replace the currently used metal honeycomb core. The deflector of the present invention has a flatter shape as compared to the deflector used in prior art blast boots, which had a severely V-shape (see for example attached FIG. 7), thus enhancing the mobility of the blast attenuators of the present invention over those of the prior art. In such prior art devices, the blast wave from the ground propagates upward along the V direction of the deflector and can impact the opposing foot. The attenuator of the present invention utilizes a deflector that has a flatter V-shape that can direct the blast wave from the ground and generally upward and dissipate to the side at a near horizontal position. Therefore, the blast wave will not impact the other foot. The second major development of the blast attenuator of the present invention resides in the use of a polymer foam or foamed composite instead of a metal honeycomb core as utilized in prior art deflectors to fill the cavity in the deflector. As is described in co-pending U.S. patent application Ser. No. 10/982,215, the foamed composites can be fabricated using a one-step or two-step process. In the case of one-step process, polymer powder or thin sheets are inserted among fabrics. The raw materials are then heated under pressure to form a consolidated panel. The consolidated panel is then foamed using a pressure vessel or autoclave. An inert gas like nitrogen or carbon dioxide is used as foaming agent. After saturating the consolidated panel with a pressurized inert fluid at an elevated temperature for a short period of time. Saturation with inert fluid can be accomplished within 10 minutes to a few hours at elevated temperatures depending on the thickness of the part. The saturating fluid is then released quickly to ambient. The foam is then cooled down controllably. This process can create micron size bubbles in the polymer matrix. No chemicals or solvents are needed for the foaming process. In the case of two-step process, the foam matrix is fabricated without fabrics. It is then sliced and bonded to fabrics, ceramic plates, or metal plates using adhesives. In the instant invention the useful fabrics include, but are not limited to, carbon/graphite, ceramic, metal mesh, and other high modulus fabrics in addition to aramid fabrics.

The features of the foam and foamed composite processed by this technique include lightweight combined with excellent blast, fragmentation and shrapnel protection. Pore sizes generally ranging from a few to about 500 micron meter in diameter. The foamed composites can be reinforced with other materials including, but not limited to, chopped fibers, whiskers, or particles of polymer, ceramic, metal or hybrids to enhance their mechanical, electrical, or thermal properties.

The main objective of the instant invention is to protect personnel from blast mine injuries and to enable wearers jumping from a high place without or with minimal injuries. A typical blast boot contains a blast wave attenuator in the sole section of the footwear. On the other hand, a combat boot has no protective insert (or attenuator) as described more fully below. Current blast wave attenuators have a V-shape. The deflector is made of steel and the cavity is filled with a metal honeycomb. The top of the honeycomb is covered with a sheet of steel. Such a blast wave attenuator weighs about 155.5 gm. When the blast wave attenuator is subjected to a mine blast or a foreign object impact the honeycomb collapses. Although a large part of the blast wave dissipates sideways, a significant amount of impact force still passes through the blast wave attenuator and can cause injuries to the foot. Since a combat boot has no blast wave attenuator the damage to the foot is much more severe in the case of a mine blast event. Mine blast attacks usually result in amputation of the foot or the loss of life.

Figure 2:
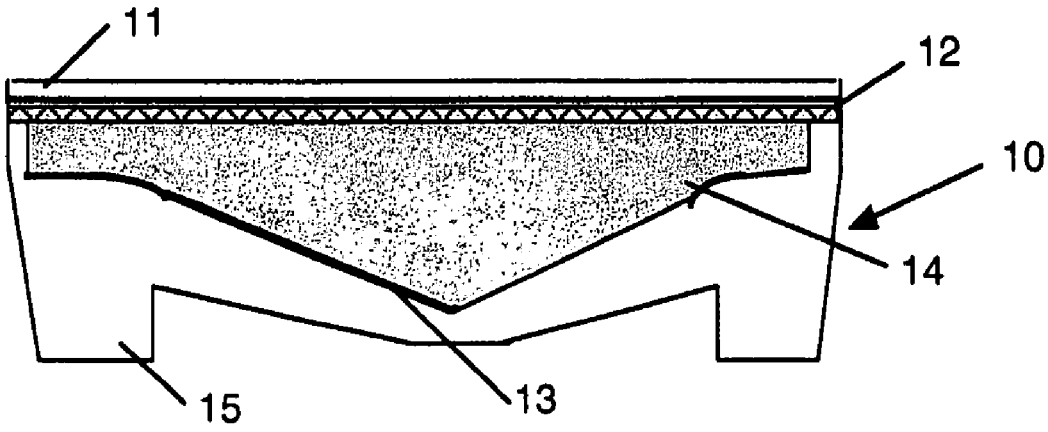
FIG. 2 is a cross-sectional end view a blast attenuator in accordance with the present invention.

Referring now to the accompanying drawings, depicted in FIG. 1, is one preferred embodiment of the blast wave attenuator of the present invention that which can be used, for example to reduce impact in combat boots or the like. As depicted in FIG. 1, a blast wave attenuator in accordance with the present invention 10 is included in only a portion of the boot sole and comprises a deflector 13 and a polymer foam or foamed composite 14 that preferably contains layers of energy absorptive and/or impact or ballistic resistant fabrics. It also may include a plurality of layers of impact resistant fabric 12, a rubber bottom 15 and a layer of elastomer 11 that serves to adhere the attenuator to a boot or other shoe type structure and provides additional impact absorption capability. FIG. 2 depicts an end view of blast attenuator 10 of FIG. 1 and shows more clearly the shallow V-shape 17 of deflector 13.

As shown in FIG. 1, deflector 13 and accordingly blast attenuator 10 can be any shape from flat as shown in FIG. 1 to shallow V-shaped, as shown in FIG. 2.

Figure 3:
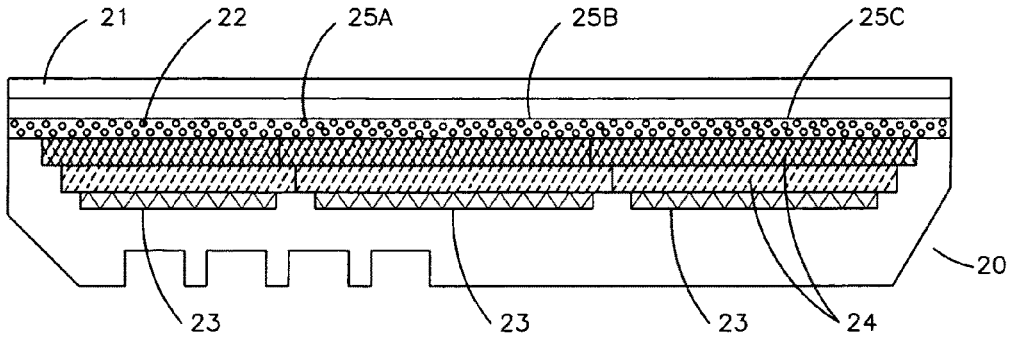
FIG. 3 is a schematic cross-sectional representation of an alternative design of the bottom section of a blast attenuator in accordance with the present invention.

In the embodiment depicted in FIG. 3, a boot sole 20 similar to that depicted in FIG. 1 is shown, except that in this embodiment, the blast wave attenuator 10 covers the entire foot rather than only a portion thereof. Additionally, blast wave attenuator 10 is formed in sections 25A, 25B and 25C to protect the entire foot such that the footwear can flex thereby enhancing comfort and mobility.

Deflector 13 can be manufactured from Titanium, stainless steel, carbon steel, superalloy, intermetallic, or other metal alloys. As shown in the accompanying Figures, it has a V-shape in the bottom and is bent smoothly to a near horizontal position at the edges. The thickness of the metal may range from about 0.005 to 0.20-in. It can be manufactured from a flat sheet of metal by cutting, bending, and welded at the joint edges. It can also be manufactured by a stamping process or drawing process for larger volume production.

The filling material of the deflector is either a polymer foam or foamed composites manufactured as described herein and generally in the manner described in the incorporated patent and patent application.

The manufacturing technique is similar to that disclosed in a co-pending U.S. patent application Ser. No. 10/982,215. The difference is that the fabric is selected from aramid fabrics or a combination of aramid fabrics and other fabrics including carbon/graphite, ceramic, metal meshes, and any other high modulus fabrics. The impact resistant fabrics may include para-aramid fabrics, polybenzobisoxazole (PBO) fabrics, and ultra high modulus polyethylene fabrics. In addition to the impact resistant fabrics a few additional layers of other kinds of fabrics may be added to tailor the structural properties including carbon/graphite, ceramic, metal meshes, glass, and other high modulus materials.

Figure 4:
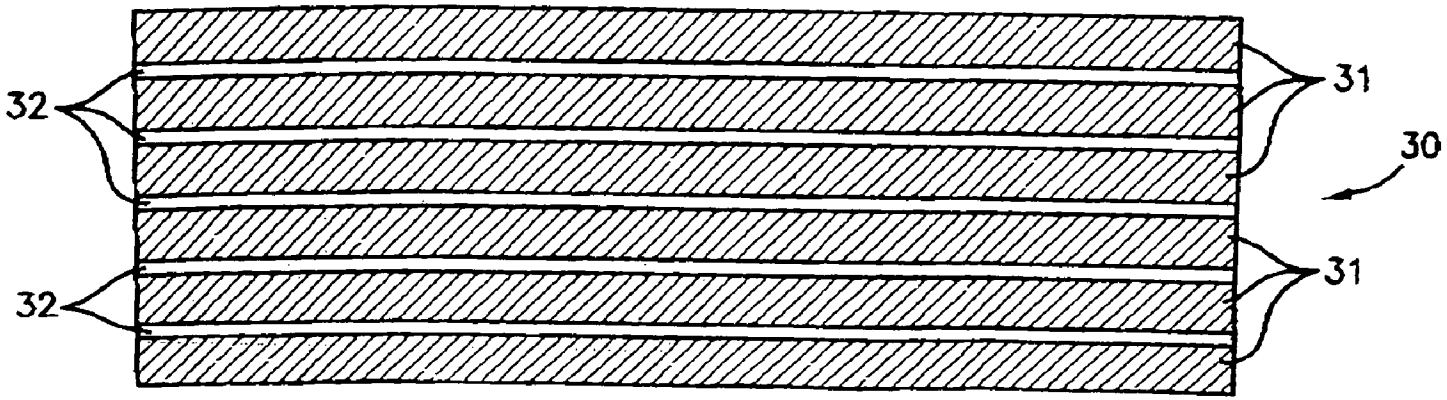
FIG. 4 is a schematic cross-sectional view of a foamed composite in accordance with the present invention.

The foam matrix is characterized by cell diameters from about 1 to about 500 micron. The pore can be either closed or open cell. A foamed composite can be fabricated by a one-step or two-step process. One-step process is to fabricate the fabric reinforced polymer foam matrix in a single step without the use of an adhesive. Two-step process is to process the foam first and bond the fabrics to the foam sheet by adhesives. A schematic of the foamed composite 30 is shown in FIG. 4. It consists of a polymer foam matrix 31 and interleaved fabric layers 32.

The foam or foamed matrix can be processed from any polymers available commercially. As previously described, it is preferred to use those that have excellent fracture toughness including but not limited to polycarbonate, liquid crystalline polymer (LCP), polyurethanes (PU), polyisocyanurate (PIR), elastomers, polyetherimide (PEI), PMMA, crystalline and semi-crystalline polymers, shape memory polymers, polyesters, epoxies, polyimides, etc. The polymer foam may be reinforced with chopped fibers, whiskers, ceramic powders, metal powders, various kinds of nano-fibers, various kinds of nano-tubes, nanowires, particles, etc. The reinforcement serves to enhance the mechanical, thermal, electrical, or other functional properties.

From the foregoing description of the drawings, it will be apparent to the skilled artisan that any arrangement of impact resistant and high modulus fabrics in foamed polymer having a cell size of between about 1 and about 500 μm is to be considered as within the scope of the present invention.

During fabrication of the foamed composite, one can spread polymer powders between adjacent layers of Kevlar®/Twaron®/PBO/Spectra® and high modulus fabrics like carbon/graphite fabrics. Alternatively, thin sheets of polymer can be used. The thickness of the foamed composite can be determined by the amount of polymer and number of fabrics used. A schematic of this layup is shown in FIG. 4. The mold is then closed and the composite molded at elevated temperatures. The molding temperature is typically about 50° C. above the Tg of the polymer and held for about 30 minutes under pressure. Subsequently, the mold is cooled to room temperature and the panel removed. The panel is then be ready for foaming.

Figure 5:
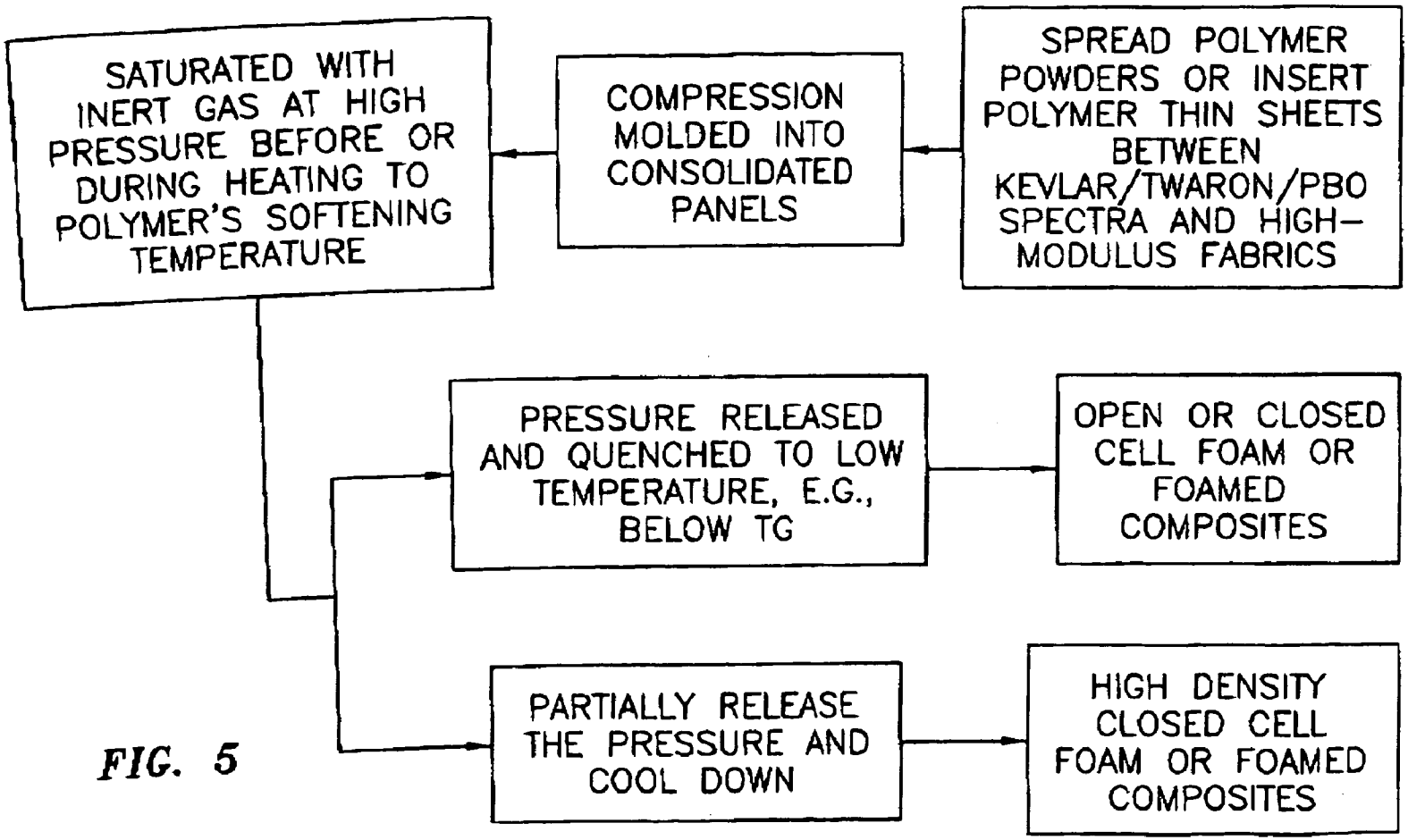
FIG. 5 is a process flow diagram for the process of making the foamed composite for the present invention.

The consolidated sample is foamed in a pressure vessel using the process schematic shown in FIG. 5 as was described in a co-pending patent application Ser. No. 10/982,215. The composite is softened in the pressure vessel by raising the temperature to its melting or softening temperature. This process is carried out under an inert gas. The consolidated composite is then saturated with an inert gas at high pressure. The saturating gas can be nitrogen, carbon dioxide, helium etc. These gases have a different solubility in the selected polymers and the choice of the appropriate gas will be determined by the porosity of the foam desired. The pressure can be applied either: (1) before the heating cycle starts; (2) during the heating step; or (3) after the temperature reaches the set point. After holding the sample at the foaming temperature and saturating pressure for a period of time, from 10 minutes to several hours depending on the thickness of the specimen, the pressure is released quickly and cooled down controllably to a temperature before the Tg of the polymer. This step locks in the microstructure of the foam or foamed composite. As shown in FIG. 5, there are two alternatives to perform the last step. The first is to release the pressure quickly and completely and cool down the sample. This can create low-density foam in the foamed composite. Another way is to release the pressure partially and cool down. This technique will create high-density closed-cell pores in the foam or foamed composite. Our foaming technique is based on the principle of thermodynamic instability that can create pores with uniform size. The pore sizes can be controlled from a few to hundreds of microns in diameter depending on a number of processing parameters like type and pressure of saturation fluid, soaking temperature, and rate of cooling.

As discussed in the previous paragraph, the holding time after the sample reaches the set temperature and pressure can be as short as about a few minutes for thin samples but can also be longer than 5 hours if the samples are excessively thick. Sufficient time is desirable for the fluid to homogeneously dissolve in the polymer matrix for the entire specimen, from surface to center. Therefore, if a longer time is needed it should not be restricted by the range of time stated above.

The present invention can apply to other kinds of fiber materials, fabric designs, different stacking sequence, different thickness and number of fabric layers, and the inclusion of high modulus fibers like graphite/carbon and glass. Any variation of this nature is intended to be within the scope of the appended claims. Any person skilled in the polymer processing arts can readily reproduce the foams and foamed composites described herein using the techniques disclosed herein.

The foams or foamed composites can be bonded to the deflector by any adhesives including but not limited to elastomers, RTV, polyurethanes, epoxies, polyesters, shoe-goo, etc.

Figure 6:
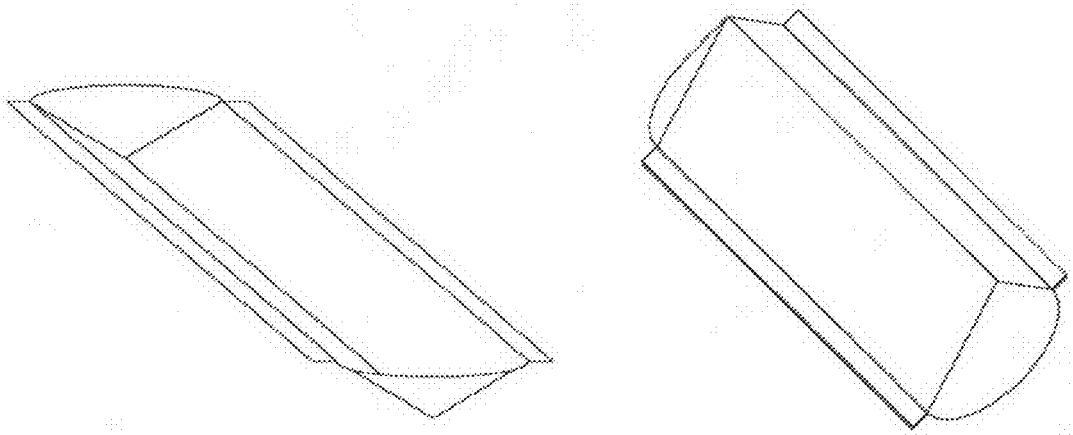
FIG. 6 provides a top view (left) and bottom view (right) of a blast wave deflector in accordance with the present invention.
Figure 7:
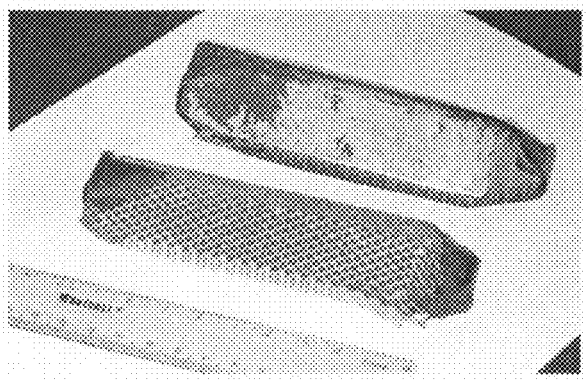
FIG. 7 Prior Art
FIG. 7 are photographs of a prior art blast wave attenuator.

In this invention the major differences between the blast wave attenuator used in a demining boot and that used in a combat boot resides in the thickness and the shape. The sole of a combat boot is normally about one inch thick while the sole of a blast boot is considerably thicker. The blast wave attenuator must fit inside the bottom sections of these boots. The blast wave attenuator of the present invention 10 (including deflector 13 and the filled foam 14) for the combat boot preferably has a height in the range of 0.2 to 1.0-in. The height of the blast wave attenuator for the blast boot ranges from about 0.5 to 3.0-in. Because of the height limitation of these boots deflector 13 for the combat boot application preferably has a larger inside angle than that of the blast wave attenuator version thereof for blast boots. The deflectors both have smooth angle to a near horizontal as shown in FIG. 6. The length of the attenuator should match the sole section of the boot with various sizes. For entire foot protection one attenuator 10 must cover the sole section and one or multiple pieces should be added to the other section to accommodate bending of the boot (see FIG. 3). The shape of a conventional blast wave attenuator is shown in FIG. 7 for comparison purposes.

To improve the fragmentation and shrapnel impact of a combat boot it is preferable to insert a stack of impact resistant fabrics as defined previously into the inside of the boot. This stack of fabrics may consist of, for example, 1 to 50 layers of impact resistant fabric depending on the thickness of the fabrics and the protection level needed. The blast wave attenuator can be used with or without this stack of impact resistant fabrics, but is preferably used with the fabrics.

Example 1

Polycarbonate (PC) powders from Teijin Kasei America, Inc. (3500 Parkway Lane, Suite 310, Norcross, Ga. 30092). Kevlar®, Twaron®, and Zylon® (PBO) fabrics were purchased from Barrday, Inc. (75 Moorefield St., P.O. Box 790, Cambridge, ON N1R 5W6) and Hexcel Schwebel (2200 South Murray Ave., Anderson, S.C.) are processed as described above at about 180 to 270° C. with nitrogen gas at 1000 to 5000 psi. The density of the foam and foamed composites ranges from about 6 pcf (pound/cubic-foot) to 26 pcf depending on the processing condition. Some deflectors from Titanium (Ti) sheet are fabricated following the procedures described above. The polycarbonate (PC) foam is then machined to fit the shape of the deflector. The foams were bonded to the deflectors by an elastomer produced by GE at room-temperature overnight. The weight of a blast wave attenuator is 89.4 gm as compared to 177 gm for similar prior art devices manufactured by Wellco Enterprises. The weight saving is 49.5%. We have also fabricated blast wave attenuators from Kevlar® fabrics reinforced PC foam and Ti sheet following the same procedures described above. These products are slightly more difficult to machine because of the Kevlar® fabrics. The weight of this blast attenuator is 83.6 gm as compared to 177 gm for Wellco's blast wave attenuator. The weight saving is 52.8%. Additional blast wave attenuators were fabricated using Twaron® fabrics and PBO fabrics reinforced PC foam and Ti deflectors.

Example 2

We have also fabricated blast wave attenuators from stainless steel sheets. There are many kinds of stainless steels including 304, 318, A286, etc. We have successfully fabricated them into deflectors. We processed and machined PC foams, Kevlar/PC foamed composites, and Twaron/PC foamed composites and bonded them to the deflectors using elastomeric adhesives. The weights of the blast wave attenuators with PC foam and with impact resistant fabrics reinforced PC foams are 107 and 112 gm, respectively. These blast wave attenuators are about 37-40% lighter than Wellco's blast wave attenuator.

Example 3

Deflectors are fabricated from a sheet of carbon steel about 0.032-in in thickness. The PC foams and impact-resistant fabrics reinforced PC foams prepared as described above are bonded to the carbon steel deflectors using an elastomer. The weights of these blast wave attenuators are 109 to 113 gm or about 38% lighter than Wellco's blast wave attenuator.

Example 4

We fabricated shorter deflectors for combat boots from a Ti sheet. The cavity-filled materials were processed and machined from polycarbonate and impact resistant fabric reinforced PC foams. The foams were bonded to the Ti deflectors with a silicon rubber compound. The completed blast wave attenuator weighs about 44.6 gm or more if thicker Ti is used. Similar blast wave attenuators for combat boots have also been fabricated from these polymer foams and stainless steels or carbon steels with various thickness.

Example 5

A foamed composite was fabricated using Polycarbonate powders from Global Polymers LLC (118 Huntington Ave. # 806, Boston, Mass. 02116) and multiple layers of Kevlar® fabric, a few layers of carbon/graphite fabrics. The composites were foamed at 200-240° C. and 1000-4000 psi of nitrogen fluid. The average weight of these materials is about 27.7 pcf (pound/cubic-foot). A cross-sectional view shows that all the fabrics are parallel and pore size are generally within 200-micron meter. Blast wave attenuators were made from these foams using Ti or stainless steel deflectors.

Example 6

Deflectors are fabricated from Ti sheet. Polyurethane (PU) foams were prepared by blending various chemicals including PMDI, polyol, catalysts, and surfactants and poured into the cavity of the deflector. PU foams were cured after several hours. Blast wave attenuators for blast boots and combat boots were completed after minor trimming to the PU foam.

Example 7

LCP foams are produced from Xydar SRT900 (LCP) powders from Amoco (4500 McGinnis Ferry Rd., Alpharetta, Ga. 30202) and impact-resistant fabric reinforced LCP foams were processed following the procedures given above under temperatures of between 360 and 440° C. and pressures of between 800 and 5000 psi. These products were machined to fit in the cavity of the deflector. Deflectors were fabricated from Ti, stainless steel, or carbon steel. The deflectors and the foam/foamed-composites were bonded together using elastomeric adhesives.

Example 8

Shape memory polymer (SMP) pellets purchased from DIAPLEX, Inc. (Ebisuminami 1-Chrome, Shibuya-Ku, Tokyo, Japan) were compression molded into panels and foamed with CO2 fluid at about 160-260° C. under 1000-5000 psi following the procedures given above. The foams were machined to fit in the cavity of the deflector. For demonstration purpose deflectors were fabricated from Ti steel. The deflectors and the SMP foams were bonded together using silicon rubber or shoe-goo. Both the blast wave attenuators for blast boots and combat boots were successfully manufactured.

Example 9

Figure 8:
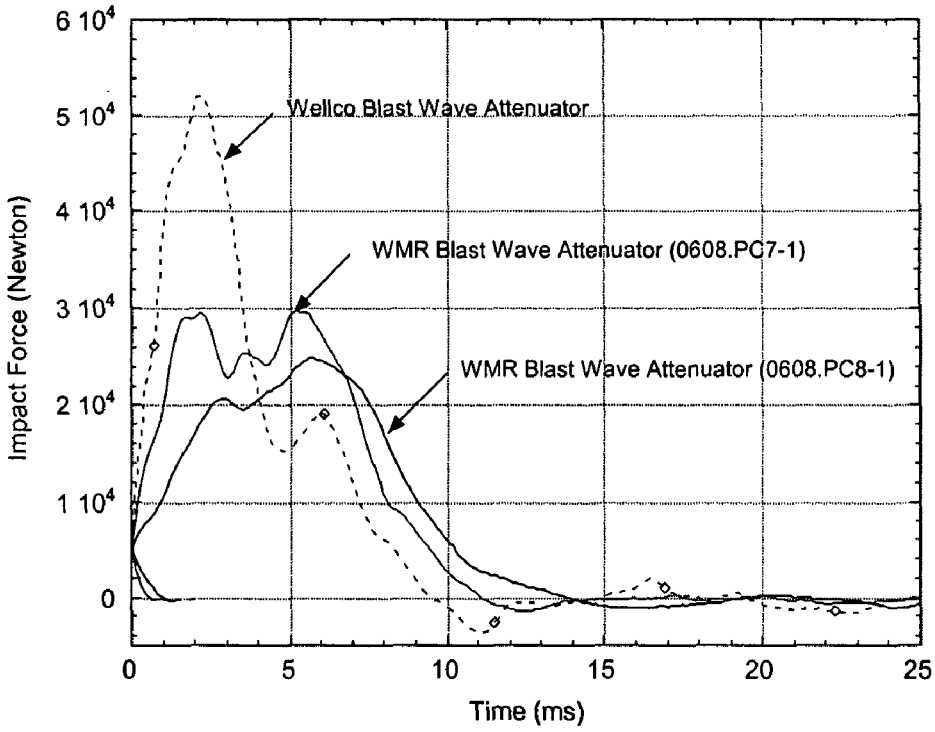
FIG. 8 shows impact force transmitted through the blast wave attenuators of the prior art and those of the present invention.

An impact tester was setup in our laboratory to evaluate the impact performance of various blast wave attenuators. It consists of two vertical posts and a horizontal bar that carries a dead weight about 64.5-lb. The horizontal bar can move freely in the vertical direction with two bushings guided by the two vertical posts. An impactor is welded to the horizontal bar. The impactor can be dropped and will strike the blast wave attenuator from any height and with any weight put on top of the horizontal bar. The impact force versus time of the tests is plotted in FIG. 8. For comparison purpose we also tested a blast wave attenuator taken from a Wellco blast boot. FIG. 8 shows the impact force versus time response of 3 kinds of blast wave attenuators: 0608.PC7-1 is made with our PC foam and Ti container; 0608.PC8-1 is fabricated from Kevlar fabric reinforced PC foam and Ti container. This figure shows that the peak impact forces of the blast wave attenuators of Wellco, WMR's PC foam/Ti deflector and Kevlar-PC foamed composite/Ti deflector are 52.0, 29.5, and 20.6 KN, respectively. The peak impact force of Wellco's blast wave attenuator is 1.76 and 2.52 times higher than our blast wave attenuators. The impact force reduction due to our new blast wave attenuators developed in this project is therefore very significant.

Example 10

Blast tests have been performed to evaluate Wellco blast boots and Belleville combat boots and to compare these boots with our blast wave attenuators. In the case of Wellco blast boots we replaced the original blast wave attenuator with our blast wave attenuator. In the case of Belleville combat boot there is no blast wave attenuator. We removed some material from the bottom of the boot and replaced them with our blast wave attenuator. The two components were bonded together using an elastomer adhesive.

Blast tests were performed using 50 gm of C-4 explosive that was hand packed into a roughly disc-like shape. The boot was set on dry sand contained in a steel cylinder about 24-in in diameter. The C-4 was buried in the sand about 1-cm under the boot. The boot carried about 64.5-lb of dead weight as mentioned in the impact test fixture in EXAMPLE 9. The C-4 was detonated from about 125-ft away through a HMX cable. Test results indicate that the Wellco blast boot has considerably more damage than the one with the blast wave attenuator of the present invention. The measurements of the peak impact forces that passed through the boots indicated that Wellco boot transmits a higher force than the boot with the blast wave attenuator of the present invention.

Example 11

Blast tests described in EXAMPLE 10 have also been performed with Bellville combat boots and the boots with our blast wave attenuators. Blast test results showed that the damage level of the Belleville boot is 3 (massive blast penetration into foot compartment of boot). It was reduced to 2 (minor blast penetration into foot compartment of boot) with our blast wave attenuators.

As the invention has been described, it will be apparent to those skilled in the art that the same may be varied in many ways without departing from the spirit and scope of the invention. Any and all such modifications are intended to be included within the scope of the appended claims.

What is claimed is:

1. In combination:

A) a boot having a sole including an upper sole face and a lower sole face; and

B) a blast attenuator attached to the sole comprising:

i. a blast deflector having a generally V-shape with an apex angle greater than 90 degrees defining a cavity bounded on all sides but one and having edges; said apex angle positioned adjacent to said lower sole face; each said edge progressively flattening until reaching near horizontal at a termination point substantially adjacent to said upper sole face;

ii. a reinforced impact absorbing polymer foam filling said cavity; and iii. at least one layer of impact absorbing fabric positioned between said blast deflector and said upper sole face.

2. The combination of claim 1 wherein said apex angle is greater than or equal to 95 degrees.

3. The combination of claim 1 wherein said apex angle is greater than or equal to 100 degrees.

4. The combination of claim 1 wherein said apex angle is greater than or equal to 120 degrees.

5. The combination of claim 1 wherein the polymer foam is reinforced with layers of fabric.

6. The combination of claim 5 wherein the layers of fabric are impact resistant.

7. The combination of claim 6 wherein the layers of fabric comprise para-aramid fabrics, polybenzobisoxazole (PBO) fabrics, and ultra-high modulus polyethylene fabrics.

8. The combination of claim 5 wherein the polymer foam contains one or more layers of fabric selected from the group consisting of carbon or graphite, ceramic, metal meshes, glass, and high modulus polymer fabrics.

9. The combination of claim 1 wherein the blast deflector is fabricated from a material selected from the group consisting of titanium, stainless steel, carbon steel, superalloys, intermetallics, and other metal alloys.

10. The combination of claim 1 wherein the polymer foam is fabricated from a material selected from the group consisting of polycarbonate, liquid crystalline polymer (LCP), polyurethanes (PU), polyisocyanurate (PIR), elastomers, polyetherimide (PEI), PMMA, crystalline and semi-crystalline polymers, shape memory polymers, polyesters, epoxies and polyimides.

11. The combination of claim 1 wherein the polymer foam is reinforced with chopped carbon or metallic fibers, carbon, ceramic or metallic whiskers, ceramic powders, metal powders, carbon nano-fibers, carbon nano-tubes, nanowires or particles.

12. The combination of claim 1 wherein the blast attenuator is segmented along the length of the boot to allow for better flexibility.

13. In combination:

A) footwear having a sole including an upper sole face and a lower sole face; and B) at least one blast attenuator positioned between said upper sole face and said lower sole face; said blast attenuator comprising:

i. a blast deflector having a generally shallow V-shape including an apex angle and having a greater lateral width than height; said blast deflector defining a cavity with two long sides and two short sides; said apex angle positioned adjacent to said lower sole face; said long sides possessing edges which progressively flatten until reaching near horizontal at a termination point substantially adjacent to said upper sole face; and ii. a reinforced impact absorbing polymer foam filling said cavity.

14. The combination of claim 13 wherein two blast attenuators are so included within said footwear.

15. The combination of claim 13 wherein three blast attenuators are so included within said footwear.

16. The combination of claim 13 wherein said apex angle is greater than 90 degrees.

17. The combination of claim 13 wherein said impact absorbing foam is exclusively disposed at a location at or above said apex angle.

18. The combination of claim 13 further comprising at least one layer of impact absorbing fabric positioned between said blast deflector and said upper sole face.

* * * * *